United States Patent [19]

Brauner

[11] Patent Number: 4,621,763

[45] Date of Patent: Nov. 11, 1986

[54] CONTAINER END CONSTRUCTION

[75] Inventor: Arne H. Brauner, Washington Crossing, Pa.

[73] Assignee: International Paper Company, New York, N.Y.

[21] Appl. No.: 775,293

[22] Filed: Sep. 12, 1985

[51] Int. Cl.[4] ..... B65D 3/18

[52] U.S. Cl. ..... 229/5.5; 229/4.5; 493/59; 493/109; 493/157; 493/308

[58] Field of Search ..... 229/5.5, 5.6, 5.8, 21, 229/48 SA, 48 SB, 48 T, 4.5, 1.5 B; 493/59–62, 109, 157, 308, 399; 156/69

[56] References Cited

U.S. PATENT DOCUMENTS

| | | | |
|---|---|---|---|
| 864,552 | 8/1907 | Perkins et al. | 83/94 |
| 952,197 | 3/1910 | Hussey | 28/5.5 |
| 1,186,184 | 6/1916 | Grasberger | 28/5.5 |
| 1,497,755 | 6/1924 | Huntley | 229/5.5 |
| 1,853,191 | 4/1932 | Benke | 493/149 |
| 1,916,519 | 7/1933 | Madsen et al. | 229/5.5 |
| 1,953,143 | 4/1934 | Wilson | 493/108 |
| 2,032,296 | 2/1936 | Meier et al. | 229/5.5 |
| 2,248,534 | 7/1941 | Meyer-Jagenberg et al. | 493/149 |
| 2,311,291 | 2/1943 | Carlson | 229/5.8 |
| 2,350,232 | 5/1944 | Hines | 229/4.5 |
| 2,392,959 | 1/1946 | Van Saun | 229/5.5 |
| 2,755,983 | 7/1956 | Ringler | 229/5.6 |
| 2,884,175 | 4/1959 | Wilson | 229/5.5 |
| 2,888,184 | 5/1959 | Hendry | 229/5.5 |
| 3,039,371 | 6/1962 | Leibreich | 229/5.5 |
| 3,583,624 | 6/1971 | Peacock | 229/5.5 |
| 3,863,550 | 2/1975 | Sarka et al. | 93/58.3 |
| 4,505,423 | 3/1985 | Balanovsky et al. | 229/5.5 |

*Primary Examiner*—William Price
*Assistant Examiner*—Gary E. Elkins
*Attorney, Agent, or Firm*—Richard J. Ancel

[57] ABSTRACT

A paperboard container having a side wall formed from a single blank. A band or zone along one edge of the blank is provided with a plurality score lines each of whose edges are non-parallel to thereby yield a wedge score indentation. The blank is rolled to assume a round or rectangular cross-section tube, and the band is bent inwardly and sealed against a closure disc or panel. By virtue of the wedge shape of the scores, the resultant gathers in the band are substantially confined within the wedge scores to yield a more uniform seal between the inwardly bent band and the closure disc or panel.

8 Claims, 13 Drawing Figures

CONTAINER END CONSTRUCTION

This invention relates to containers made of paperboard or similar sheet material which is resilient, stiff and bendable. The invention more particularly relates to liquid tight containers of the so-called tube type which are either round or rectangular in cross-section.

When fabricating a single wrapped cylindrical package the side wall must be made with a sealing flange at the bottom, which is folded 90° and sealed to a bottom closure base panel or disc. When the sealing flange is folded 90°, along the curved edge that separates the container side walls from the end closure panel, the innermost edge of the flange must be gathered (to match the reduced perimeter) towards the center of the end closure panel. This is typically accomplished by placing score lines of relatively narrow, uniform width transversely and at short distances apart along the length of the flange panel or band, as may be seen by reference to U.S. Pat. No. 3,583,624 issued to Peacock, hereby incorporated by reference. However, the flange gathers by folding on the edges of the score line. The disadvantage of such a construction is that it forces the flange material to gather within the limits of the score width, which width is not wide enough to accommodate all of the gathering that is required. As a result, some score lines are forced to gather more material than others, resulting in a non-uniform seal area, the less uniform the seal areas are, the greater is the risk of incomplete seals.

According to the practice of this invention, the noted inconsistent formation of the gathered sheet material is overcome by the provision of generally wedge-shaped score indentations or lines, i.e., scores wherein the edges thereof are not parallel, rather are non-parallel. This construction results in a zone of weakness characterized by non-parallel edges. This permits the gathering of the flange material to a predictable and more uniform extent. By virtue of this construction, inconsistencies in gathering which have been experienced with the prior art are alleviated. Such inconsistent gathering appears to occur because the gathering must occur entirely within the limits of the width of the parallel score, this width being too narrow. By the use of the present construction, there is ample room for gathering and the gathers are more uniform.

IN THE DRAWINGS

FIGS. 1–4 disclose a typical prior art construction for forming containers fashioned from paperboard or the like, wherein one end of the tube type container is closed by the inward bending of a scored band or flange along one edge of a unitary blank, in cooperation with a closure disc.

FIGS. 5–8 correspond to FIGS. 1–4, respectively, and illustrate the construction of this invention.

Figure 1:
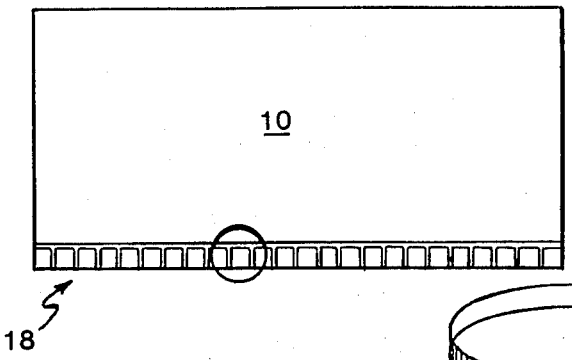
FIG. 1 PRIOR ART
Figure 2:
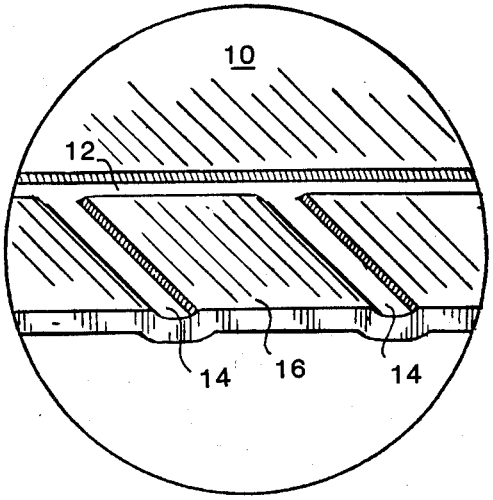
FIG. 2 PRIOR ART

Referring now to the drawings, the numeral 10 at FIG. 1 denotes a blank formed of paperboard or other stiff, resilient and bendable material. As indicated at FIG. 2, the lower band or flange portion of the blank 10 is provided with a continuous score 12 substantially parallel to the lower rim or edge of the band, with parallel sided scores 14, spaced apart from each other, and defining interscore areas or zones 16 therebetween. As indicated at FIG. 1, this lower band is denoted generally by the numeral 18.

Figure 3:
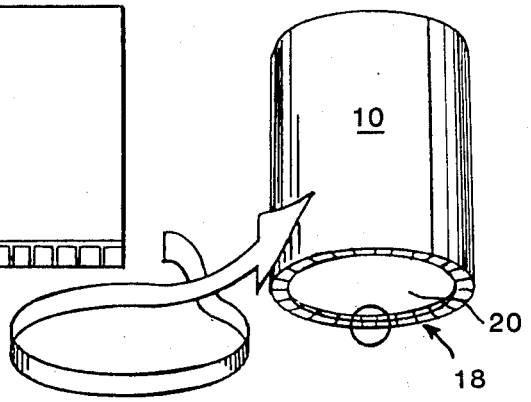
FIG. 3 PRIOR ART
Figure 4:
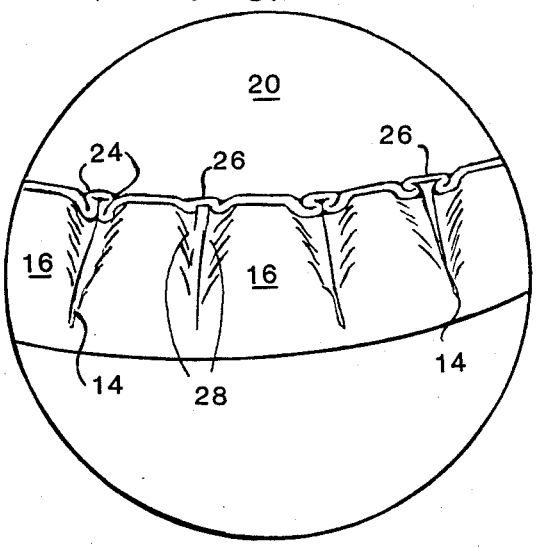
FIG. 4 PRIOR ART

FIG. 3 shows the formation of the lower part of a container after it has been rolled (as indicated by the curved arrow) and provided with a bottom closure disc 20 and after band 18 has been inwardly folded. As indicated at FIG. 4, the gathers and folds which result are indicated by the numerals 24, 26 and 28. Numeral 24 denotes a fold area while numeral 26 denotes the width of a fold, and numeral 28 denotes a gathering area. It will be observed that the folds and gathers are not, in general, uniform. The construction shown at FIGS. 1 through 4 is substantially that as has been practiced in the prior art, as exemplified by the above noted patent to Peacock.

Referring now to FIGS. 5 through 8, the end closure construction according to the present invention will now be described.

Figure 7:
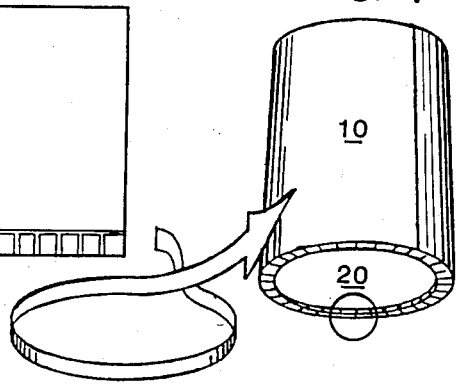

In FIG. 5, the numeral 10 again denotes a blank formed of paperboard or the like, the blank having a lower band 18. As shown at FIG. 6, the lower band 18 which runs along the lower portion of the blank 10 includes a continuous score 12, similar to score 12 shown at FIG. 2. The numeral 30 denotes wedge shaped scores or indentations which are uniformly spaced along band 18, the uniform spacing being preferable for the formation of a round container such as shown at FIG. 7. Each score 30 has non-parallel sides and has a wide end 31 and a narrow end 32, ends 32 preferably communicating with score 12. The interscore regions between wedge shaped scores 30 are denoted by the numeral 33. It will be seen that the widest portions 31 of the wedge shaped scores 30 are at the lower rim of band 18.

Figure 5:
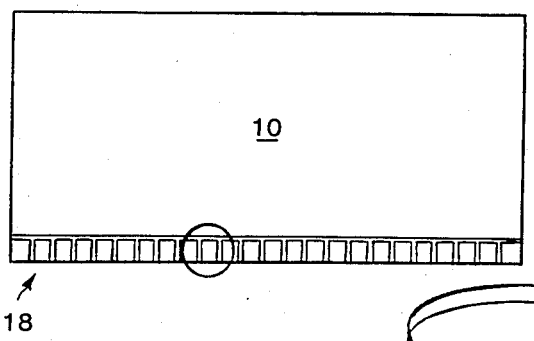
Figure 6:
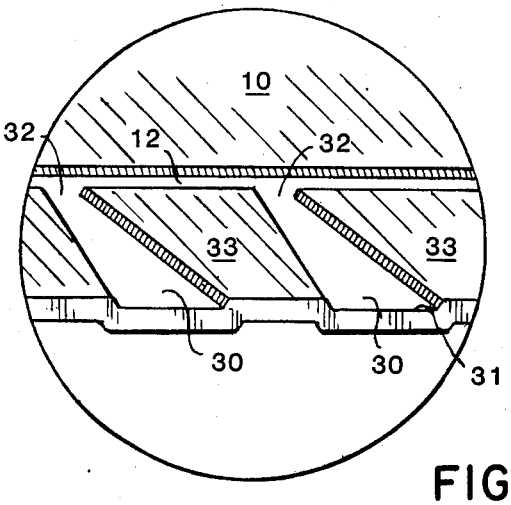

To form, for example, a circular tube-type container, the blank of FIG. 5 is folded, as indicated by the solid arrow, to assume a round configuration and a disc 20 placed in the bottom, with band 18 having been bent inwardly 90° to form a seal with the closure disc 20. The formation of such a seal, as by pressing, is known in the art and may be seen, for example, by reference to U.S. Pat. No. 4,505,423 issued to Belanovsky et al, hereby incorporated by reference.

Figure 8:
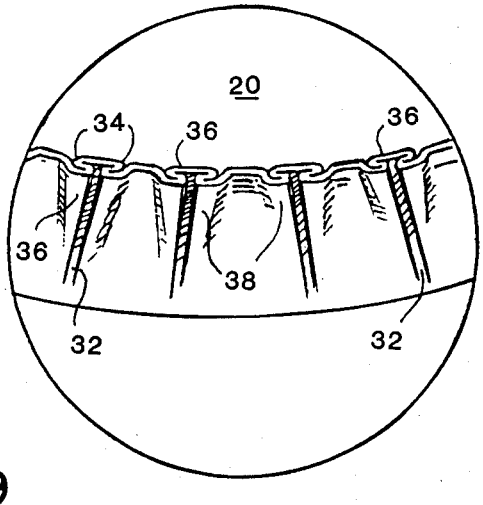

FIG. 8 illustrates the completed construction according to the present invention. A comparison of FIGS. 4 and 8 shows that the fold area 34 of FIG. 8 and the width of the gathered area 36 is of a different configuration than the corresponding zones and lengths 24 and 26 of the prior art of FIG. 4. Numeral 38 of FIG. 8 illustrates the gathering area.

Figure 9:
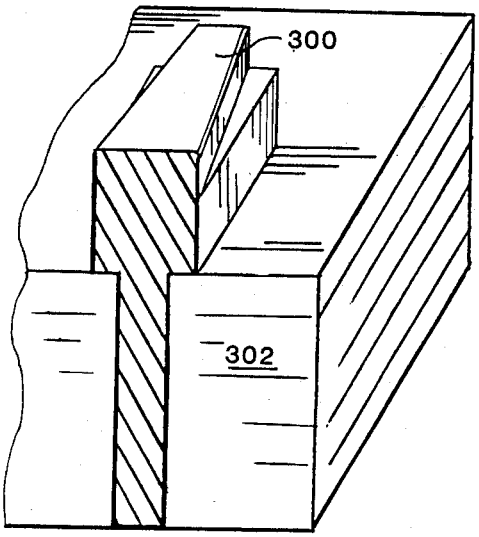
FIG. 9 is a perspective view of a scoring die employed to form the wedge-shaped scores on the band or flange shown at FIG. 6.

Referring now to FIG. 9, a scoring device 300 having a shape complementary to scores 30 of FIG. 6 may be employed, with scoring die or device 300 mounted in a die board 302.

Referring now to FIGS. 10–13, an embodiment of the invention will now be described, this embodiment being particularly adapted for the formation of tube-type containers of generally rectangular form.

In the case of a package with a square cross-section and radiused corners, the flange in the area of the radiused corners must be gathered like it is on a round package. In this case, however, the radius in the curved corner is so much smaller than that of a round package, that the flange must be notched and scored to turn the corner so abruptly. Gathering in the scored area presents the same problem as in the case of a round package.

Figure 10:
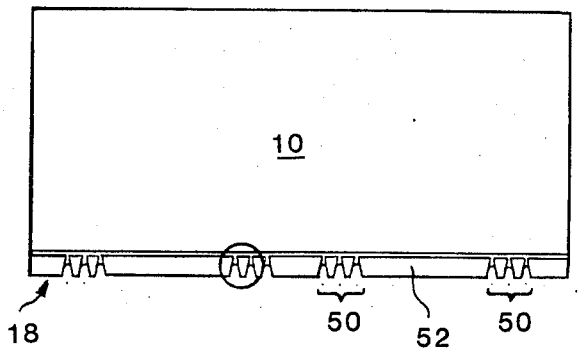
FIGS. 10–13 illustrate a modification of the construction of this invention, this modification being particularly adopted for the formation of non-round or rectangular tubular containers.
Figure 11:
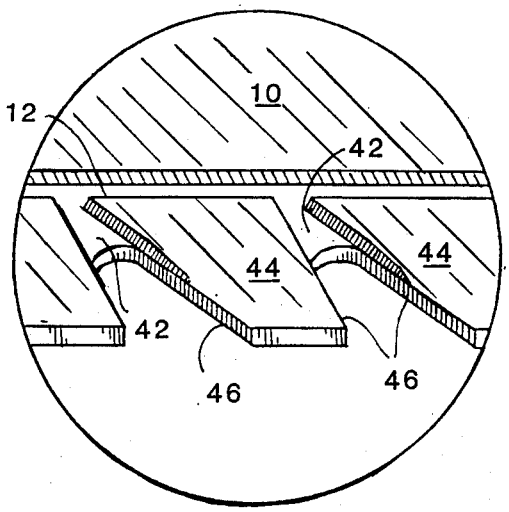

At FIG. 10, the numeral 10 again denotes a unitary blank fashioned of paperboard or the like and having a lower margin or band 18. Again, the lower band 18, as shown at FIG. 11, is provided with a continuous score 12 parallel to the lower rim of the band. The numeral 42 denotes wedge-shaped scores, fashioned in a manner similar to wedge shaped scores 30 of the embodiment of FIG. 6. In FIG. 10, however, substantially one-half of the wedge-shaped scores 42 have been removed, as by cutting, thereby removing the (original) widest portions of scores 42 to form notches. The numeral 46 denotes the non-parallel edges of the notches resulting from this removal or cutting away. It will be understood, however, that the cutting away may be performed prior to the impression of a die such as die 300 of FIG. 9 to form the wedge-shaped scores 42.

Again referring to FIG. 10, it will be seen that discrete groups, denoted by the numeral 50, of wedge-shaped scores 42 and cut away or notched portions, defining non-parallel edges 46 are employed along the band 18, with numeral 52 denoting those portions of band 18 which are not provided with groups of wedge shaped scores 42.

Figure 12:
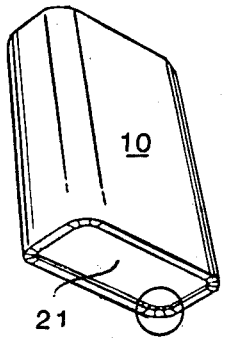

The blank of FIG. 10 is folded, in accordance with known techniques, to form a tube-type construction shown at FIG. 12, the tube being of generally rectangular cross-section and having a bottom closure denoted by the numeral 21. The bottom closure 21, just as bottom closure 20 of the previously described embodiments is also preferably formed of paperboard.

Figure 13:
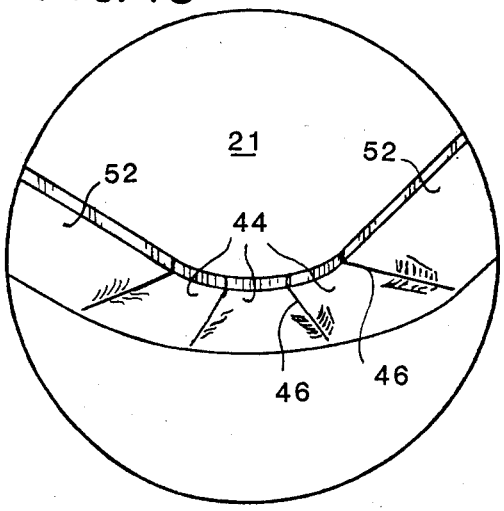

FIG. 13 illustrates how the corners of the rectangular bottom of the container of FIG. 12 appear after the bending operation. By virtue of the non-parallel wedge scores 42 and edges 46, edges 46 come together to abut each other, the result being that there are no gathers in the inwardly folded band 18 of the container side wall. Thus, the inward bending 90° of the band 18 of FIG. 10, to form the blank of FIG. 12, results in a bottom closure construction having two substantially well defined planes, one being the plane of band 18 (portions 52 and 44) and the other being plane of closure member 21.

While the invention has been described with respect to an end closure construction for a flat bottomed container, it can also be applied to a recessed bottom type of construction, such as the recessed bottom shown in U.S. Pat. No. 3,137,431 issued to Crouse et al, hereby incorporated by reference. The recessed bottom construction can be for a round container, utilizing the uniformly spaced scores 30 of FIGS. 5 to 8, or utilizing the notched, wedged scores 42, 44, 46 of FIGS. 10 to 13 for a rectangular container, having radiused corners, such as that shown in the noted Crouse et al patent.

What is claimed is:

1. A blank for forming a side wall and a portion of an end closure of a tube type container, the blank being formed of resilient, stiff and bendable sheet stock, such as paperboard, the blank including a lower rim and a band running therealong, the band having a plurality of generally wedge shaped scores therein, the scores being spaced from each other along said band, each score including a narrow end and a widest end, the widest ends of the scores being at the rim of the band, a continuous score of substantially uniform width running parallel to said rim and spaced therefrom and contiguous with the narrow ends of the scores, the band being adapted to be bent inwardly to form folds after the blank has been formed into a tube, the band also being adapted to contact and seal against an end closure disc or panel, so that the folds in the band are at least substantially contained within the wedge shaped scores to yield an improved seal of the inwardly folded band and the closure disc or panel.

2. The blank of claim 1 wherein said score running parallel with said rim communicates with the narrow ends of the wedge shaped scores.

3. The blank of claim 1 wherein the wedge shaped scores are uniformly spaced from each other.

4. The blank of claim 3 further comprising interscore regions between the wedge shaped scores, and wherein the width of the widest portion of each wedge shaped score, measured along said rim, is at least as great as the width of the interscore regions, also measured along said rim.

5. The method of making a tube-type container from a single blank of stiff, resilient and bendable sheet material, such as paperboard, and from an end closure disc having a periphery, comprising the steps of forming a plurality of wedge shaped scores along an edge band of the blank, bending the blank to form a tube, placing the end closure disc adjacent one open end of the tube to close said open end, bending the wedge shaped scores inwardly to form folds and gathers which abut the periphery of the closure disc on one surface thereof, fixing the bent-in wedge shaped scores to said disc periphery, whereby the folds and gathers of the edge band are each of substantially the same configuration.

6. The method of claim 5 wherein the wedge shaped scores include narrow ends which are spaced inwardly from a lower rim of said edge band, including the additional step of making a continuous score line in the blank, on the same blank side as the wedge shaped scores, the continuous score line communicating with the narrow ends of the wedge shaped scores.

7. The method of claim 5 wherein the wedge shaped scores include widest ends located at a lower rim of said edge band, and the wedge shaped scores further include interscore regions, the width of the widest portion of each wedge shaped score, measured along said edge band, is at least as great as the width of the interscore regions, also measured along said edge band.

8. The method of making a tube-type container of generally rectangular cross-section from a unitary blank of stiff, resilient and bendable sheet material, such as paperboard, and from a rectangular end closure, the method including the steps of providing an end forming edge band of the blank with a plurality of spaced groups of wedge shaped scores, each wedge shaped score having a widest part at a free edge of said end forming edge of blank, removing a portion of the widest portion of each wedge shaped score to thereby define a notch having non-parallel sides at each wedge-shaped score, bending the blank to form a container side wall of rectangular cross-section, positioning the end closure adjacent said end of the blank to close that end, each group of notches being adjacent a corner bend of the tube, bending the edge band inwardly so as to lie flat against the end closure, the non-parallel, opposite edges of each notch abutting one another in the regions of the corners of the end closure, whereby the edge band of the completed end closure lies in a single plane, and securing the bent band to the end closure.

* * * * *